US009359765B2

(12) United States Patent
Svec

(10) Patent No.: US 9,359,765 B2
(45) Date of Patent: Jun. 7, 2016

(54) HIGH SPEED GRANULE DELIVERY SYSTEM AND METHOD

(75) Inventor: James A. Svec, Kearny, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 13/584,094

(22) Filed: Aug. 13, 2012

(65) Prior Publication Data

US 2014/0044871 A1 Feb. 13, 2014

(51) Int. Cl.

| | |
|---|---|
| ***B05D 5/02*** | (2006.01) |
| ***E04D 1/26*** | (2006.01) |
| *E04D 1/00* | (2006.01) |

(52) U.S. Cl.

CPC ..... *E04D 1/26* (2013.01); *B05D 2401/32* (2013.01); *E04D 2001/005* (2013.01)

(58) Field of Classification Search

None

See application file for complete search history.

(56) References Cited

U.S. PATENT DOCUMENTS

| | | | | |
|---|---|---|---|---|
| 4,266,695 | A | 5/1981 | Ruperez | |
| 4,284,030 | A * | 8/1981 | Hamilton | G01F 11/24 118/406 |
| 4,994,053 | A * | 2/1991 | Lang | 604/367 |
| 5,181,629 | A | 1/1993 | Camm et al. | |
| 5,599,581 | A | 2/1997 | Burton et al. | |
| 5,795,389 | A | 8/1998 | Koschitzky | |
| 5,814,369 | A | 9/1998 | Bockh et al. | |
| 5,858,095 | A | 1/1999 | White et al. | |
| 5,944,233 | A | 8/1999 | Bourne | |
| 5,997,644 | A | 12/1999 | Zickell | |
| 6,440,216 | B1 | 8/2002 | Aschenbeck | |
| 6,511,704 | B1 | 1/2003 | Zickell | |
| 6,582,760 | B2 | 6/2003 | Aschenbeck | |
| 6,635,140 | B2 | 10/2003 | Phillips et al. | |
| 2003/0044525 | A1 | 3/2003 | Aschenbeck | |
| 2003/0126831 | A1 * | 7/2003 | Altvater et al. | 53/122 |
| 2006/0024433 | A1 * | 2/2006 | Blessing et al. | 427/180 |
| 2007/0082126 | A1 * | 4/2007 | Aschenbeck | 427/188 |
| 2011/0130732 | A1 * | 6/2011 | Jackels et al. | 604/365 |
| 2011/0200747 | A1 * | 8/2011 | Kida et al. | 427/209 |
| 2011/0229636 | A1 | 9/2011 | Aschenbeck et al. | |
| 2012/0058213 | A1 * | 3/2012 | Lindee et al. | 425/135 |

* cited by examiner

*Primary Examiner* — Charles Capozzi

(74) *Attorney, Agent, or Firm* — Womble Carlyle Sandridge & Rice LLP

(57) ABSTRACT

A high speed granule delivery system and method is disclosed for dispensing granules in intermittent patterns onto a moving asphalt coated strip in the manufacture of roofing shingles. The system includes a granule hopper and a rotationally indexable pocket wheel in the bottom of the hopper. A series of pockets are formed in the circumference of the wheel and the pockets are separated by raised lands. A seal on the bottom of the hopper seals against the raised lands as the wheel is indexed. In use, the pockets of the pocket wheel drive through and are filled with granules in the bottom of the hopper. As each pocket is indexed beyond the seal, it is exposed to the moving asphalt coated strip below and its granules fall onto the strip to be embedded in the hot tacky asphalt. Well defined patterns of granules are possible at high production rates.

17 Claims, 4 Drawing Sheets

HIGH SPEED GRANULE DELIVERY SYSTEM AND METHOD

TECHNICAL FIELD

This disclosure relates generally to asphalt shingle manufacturing and more particularly to systems and methods of applying granules to a rapidly moving web of substrate material coated with asphalt.

BACKGROUND

Asphalt-based roofing materials, such as roofing shingles, roll roofing, and commercial roofing, have long been installed on the roofs of buildings to provide protection from the elements and to give the roof an aesthetically pleasing look. Typically, asphalt-based roofing material is constructed of a substrate such as a glass fiber mat or an organic felt mat, an asphalt coating on the substrate to provide a water barrier, and a surface layer of granules embedded in the asphalt coating. The granules protect the asphalt from deterioration due to exposure to UV and IR radiation from the sun and direct exposure to the elements.

A common method of manufacturing asphalt-based shingles is to advance a sheet or web of the substrate material through a coater, which coats the web with liquid asphalt forming a hot tacky asphalt coated strip. The asphalt coated strip is typically then passed beneath one or more granule dispensers, which discharge or dispense protective and decorative surface granules onto at least selected portions of the moving asphalt coated strip. A granule dispenser may be as simple as a direct feed nozzle fed by an open hopper that is filled with granules or as complex as a granule blender. The result is a strip of shingle stock, which can later be cut to size to form individual shingles, cut and rolled to form a rolled shingle, or otherwise processed into final products.

In some shingle manufacturing processes, there is a need to deliver granules at intermittently timed intervals such that granules are deposited on the asphalt coated strip in spaced patterns. In such cases, several mechanisms have been used in the past to start and stop the delivery of granules in a controlled manner. For example, a fluted roll has been inserted at the bottom of a granule dispenser nozzle such that rotation of the fluted roll pulls a charge of granules from a granule hopper and throws the granules a set distance (generally over 12 inches) onto the asphalt coated strip below. In some cases, the charge of granules slides down a polished curved surface toward the substrate material. The curved surface in conjunction with gravity accelerates the charge of granules to approximately the speed of the moving asphalt coated strip below and deposits the charge of granules gently onto the asphalt.

Prior systems and methods of depositing granules onto an asphalt coated strip in shingle manufacturing have exhibited a variety of inherent problems. Chief among these is that as the speed of production increases, meaning that the speed of the moving asphalt coated strip increases, the edges and patterns of dispensed charges of granules on the asphalt become less and less defined. Eventually, the deposited patterns of granules are so indistinct and distorted as to be unacceptable in appearance, coverage, and protection. Trailing edges in particular of a deposited charge of granules become more and more smeared out as the speed of production is increased and dispensed charges of granules exhibit unacceptable trailing patterns. As a result, granule delivery systems and methods in the past have been practically limited to production speeds below about 800 feet per minute (FPM) of asphalt coated strip travel, even though other areas of production are capable of moving much faster.

There is a need for a granule delivery system and method for use in shingle manufacturing that is capable of delivering a charge of granules at intermittently timed intervals onto a moving asphalt coated strip with precision, definition, and controllability at manufacturing speeds of over 800 FPM and even over 1000 FPM. It is to the provision of such an apparatus and method that the present invention is primarily directed.

SUMMARY

Briefly described, a granule delivery system and method are disclosed for dispensing charges of granules intermittently onto a moving asphalt coated strip as the strip is moved in a downstream direction beneath the system. The delivery system includes a hopper for containing a supply or store of granules. A generally cylindrical pocket wheel is mounted at the bottom portion of the hopper with the upper portion of the wheel exposed to granules in the hopper and the lower portion of the wheel exposed to the moving asphalt coated strip below. The outer surface of the rotor is formed with a series of pockets separated by upstanding or raised lands. In one embodiment, a total of six pockets are formed around the periphery of the pocket wheel, although more or fewer than six pockets are possible. A brush seal is located at the bottom of the hopper and includes brushes or other sealing members positioned to ride on the lands of the pocket wheel as they lands are rotated past the brush seal. The brush seal also rides across the open pockets as the pockets rotate out of the hopper to level a charge of granules collected by the pockets and thereby insure that a substantially consistent volume of granules is contained by each pocket.

The pocket wheel is driven through a gear train by a servo motor that is controlled by a computer controller to index the pocket wheel at a controlled speed and through a prescribed rotational angle. More specifically, the pocket wheel is rotated from one position where the brush seal seals against one land to a successive position where the brush seal seals against the next successive land. In the process, the pocket defined between the two lands rotates downwardly and is progressively exposed in an inverted orientation above the moving asphalt coated strip below.

In operation, the hopper is filled with granules, an asphalt coated strip is moved below the dispenser at a production speed, and the pocket wheel is repeatedly indexed as described. As the pocket wheel rotates in indexed increments, the pockets around the circumference of the wheel move through the granules in the hopper as the pockets traverse the upper portion of the wheel. The pockets are filled with granules as they drive through the store of granules. As each pocket is indexed past the brush seal, the seal rides across the open pocket to level the granules within the pocket, which immediately begin to drop out of the now inverted pocket toward the moving asphalt coated strip below. The granules thus are deposited on the asphalt in a pattern that substantially corresponds with the shape of the pocket.

The surface speed at which the pocket wheel is indexed is coordinated with the production speed of the asphalt coated strip below. Accordingly, the charge of granules is moving in the production direction at about the same speed as the asphalt coated strip when the granules fall onto the strip. Thus, a well defined pattern of granules is deposited and subsequent operation of the system forms a sequential pattern of deposited granules along the length of the asphalt coated strip. It has been found that the system and method of this invention is capable of depositing a charge of granules that is characterized by very good uniformity, well defined edges, and little distortion. Furthermore, these characteristics have been found to be preserved at production speeds substantially higher than those obtainable with prior art granule blenders and other granule dispensing devices.

Accordingly, a system and method of delivering charges of granules onto a moving asphalt coated strip in shingle production is disclosed that addresses successfully the problems and shortcomings of existing granule dispensing technology and deposits highly defined patterns of granules at production speeds exceeding the capability of existing equipment. These and other aspects, features, and advantages of the invention will be better appreciated upon review of the detailed description set forth below, taken in conjunction with the accompanying drawing figures, which are briefly described as follows.

DETAILED DESCRIPTION

Figure 1:
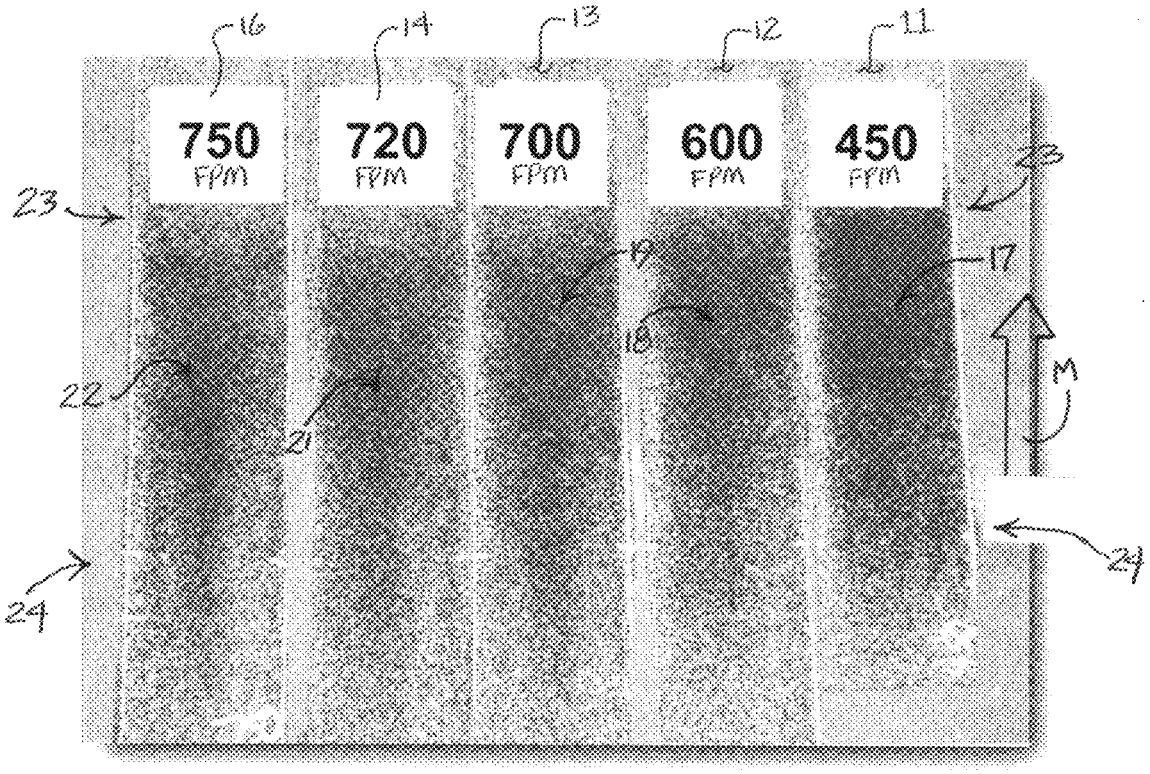
FIG. 1 (Prior Art)
FIG. 1 shows granule patterns on strips of material resulting from a traditional prior art granule delivery system run at various increasing production speeds.

Reference will now be made in more detail to the drawing figures, wherein like reference numerals, where appropriate, indicate like parts throughout the several views. FIG. 1 illustrates the production speed limitations of a traditional prior art "granule blender" type granule delivery system. Five webs of material 11, 12, 13, 14, and 16 were advanced along a shingle production line at five different production rates. As illustrated, web 11 was advanced at 450 FPM, web 12 at 600 FPM, web 13 at 700 FPM, web 14 at 720 FPM, and web 16 was advanced at 750 FPM. As each web moved beneath the granule blender, the blender dropped granules onto the moving web in the traditional prior art manner. In FIG. 1, the machine direction in which the strips of material moved is indicated by arrow M. In each case, a pattern of granules 17, 18, 19, 21, and 22 was deposited onto the respective strip of material by the granule blender. The leading edges of each granule pattern are at the top of FIG. 1 and indicated by numeral 23. Trailing edges are near the bottom of FIG. 1 and are indicated by numeral 24.

As can be seen from FIG. 1, at a production or web speed of 450 FPM, which is a common production speed in the industry, a reasonably tight and well defined pattern of granules is deposited onto the strip 11. There is some trailing edge patterning, but within acceptable limits. This pattern is acceptable and common for commercial shingle production. As the production speed is increased, the pattern of granules deposited by the prior art granule blender delivery system becomes more and more degraded. At 600 FPM, for instance, the pattern appears a bit more indistinct, the trailing edge 24 is thinned and spread more in the non-machine direction, and the leading edge 23 is less distinct. The same phenomenon continues with increasing production speeds until at 750 FPM production speed, the deposited granules are unacceptably patterned throughout, and the leading and trailing edges of the pattern are unacceptably indistinct. It will thus be seen that traditional prior art granule delivery systems limit the practical production speed of a shingle manufacturing operation to somewhat less than 750 FPM.

Figure 2:
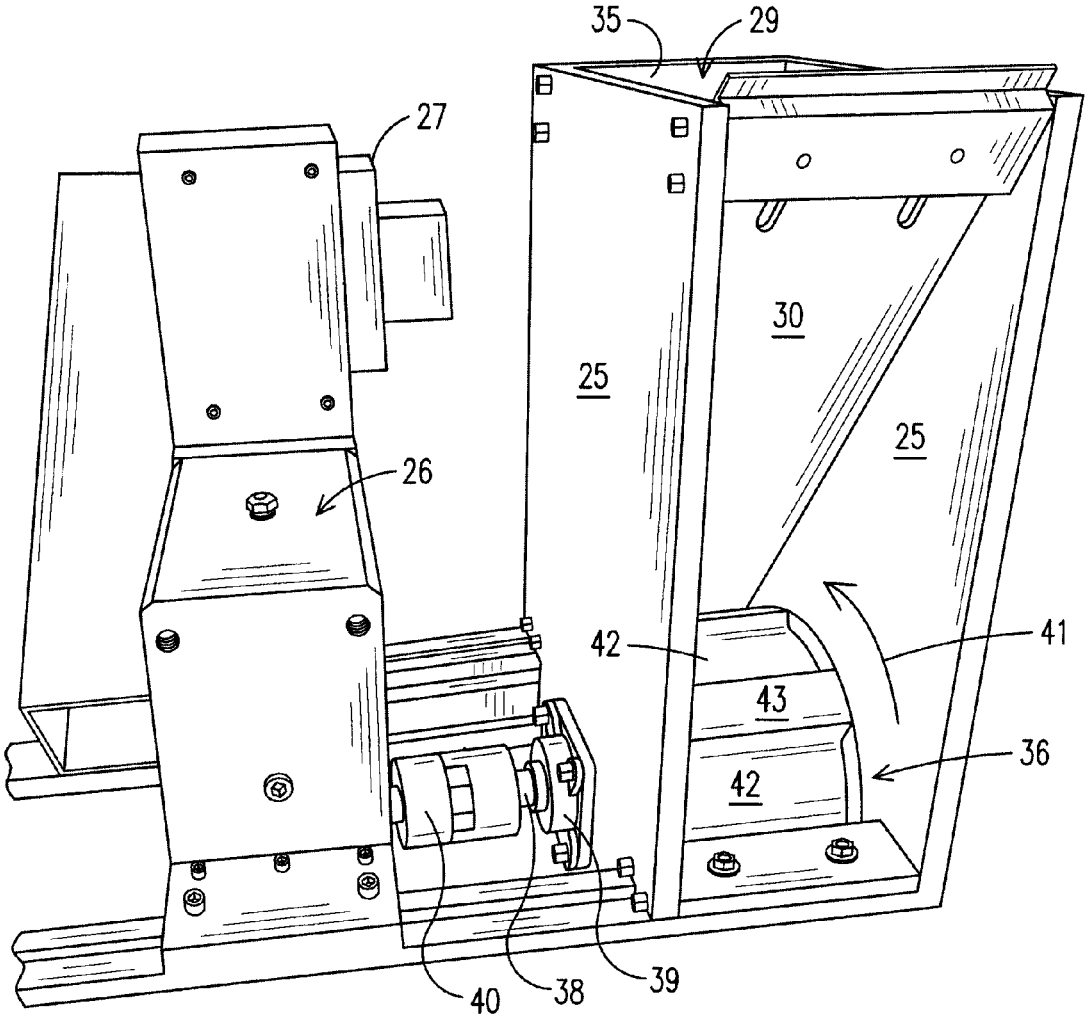
FIG. 2 is a perspective view of a prototype apparatus that embodies principles of the system.

FIG. 2 shows a prototype apparatus that was built to test the methodology of the present invention. The prototype apparatus comprises a housing at least partially defined by side walls 25. A hopper wall 30 is mounted between the side walls 25 and extends downwardly at an angle toward the bottom rear portion of the housing. A rear wall 35 closes the back side of the housing and together with the angled hopper wall 30 defines an open top hopper 29 for receiving and holding a store of granules to be dispensed by the apparatus. A pocket wheel 36 is mounted in the bottom portion of the housing via a shaft 38 journaled in bearings 39 such that the pocket wheel is rotatable in the direction of arrow 41. The shaft 38 is coupled through coupler 40 to a reduction gear assembly 26, which, in turn, is driven by a computer controlled servo motor housed within servo motor housing 27.

The pocket wheel 36 in this embodiment is generally cylindrical in shape and its peripheral surface is formed with a series of depressed pockets 42 separated by raised lands 43. In the prototype shown in FIG. 2, a total of six pockets 42 are formed around the periphery of the pocket wheel 36; however, more or fewer than six pockets are possible within the scope of the invention. Further, the pockets of the prototype are generally rectangular, but they may have other configurations for depositing granule charges in different patters as described in more detail below. In operation, the servo motor is controlled to cause the pocket wheel 36 to rotate in direction 41 in incremental steps of one-sixth of a circle, or 60 degrees in this case. In other words, the pocket wheel is incremented through 60 degrees and then stops for a predetermined time before being incremented again through 60 degrees and so on. The time between incremental rotations as well as the speed of rotation during incremental rotations can be controlled to correspond to a given production rate.

Figure 3:
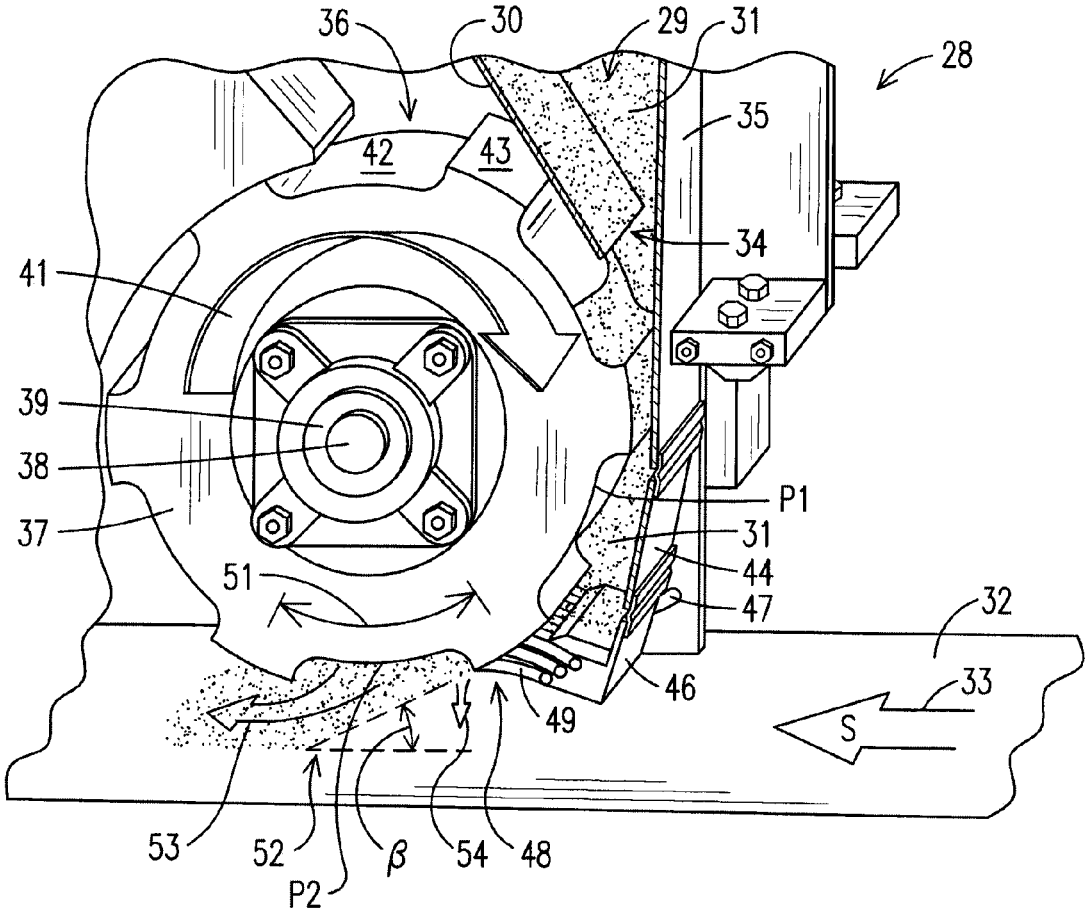
FIG. 3 is a partially sectioned perspective view of a system that embodies principles of the present invention showing operation of the system to deliver granules to a asphalt coated strip.
Figure 4:
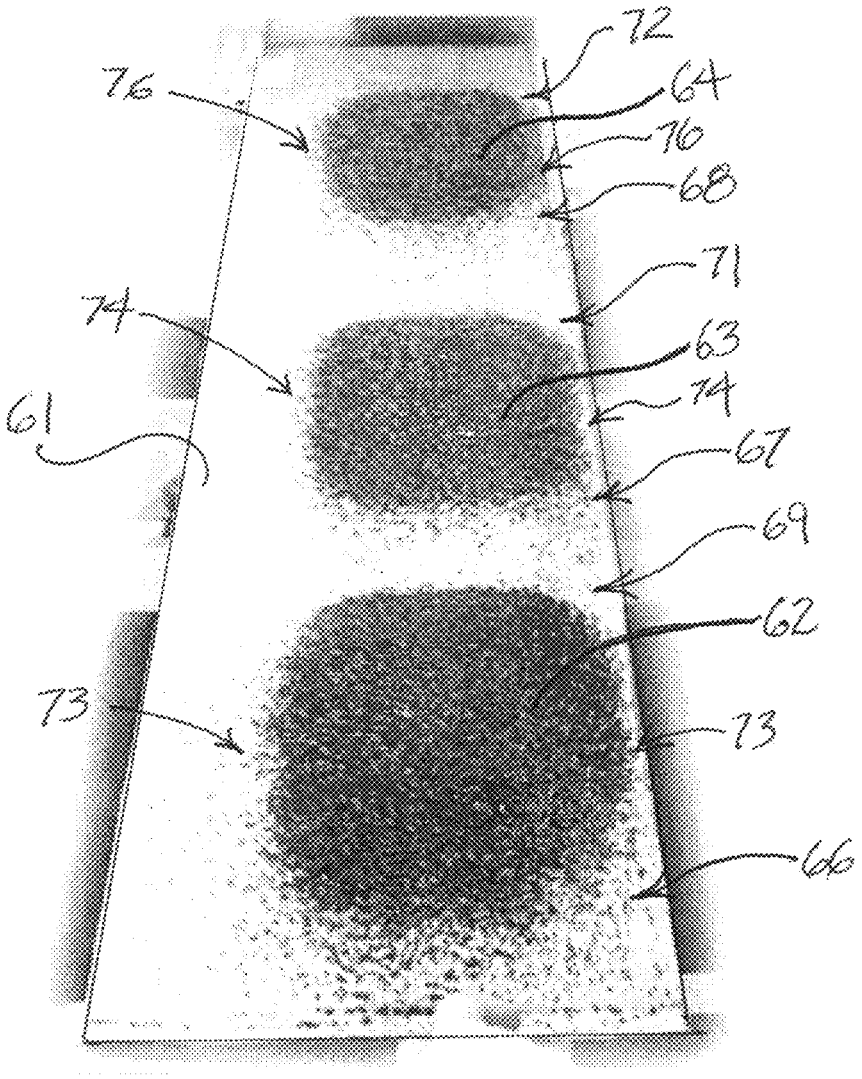
FIG. 4 shows granule patterns on a strip of material resulting from use of the system of this invention to deliver granules on the strip.

FIG. 3 illustrates in more detail the high speed granule delivery system 28 for depositing a charge of granules onto a moving asphalt coated strip 32. The system 28 comprises a granule hopper 29 (only the lower portion of which is visible in FIG. 2) having a nozzle or mouth 34. The mouth 34 of the hopper is generally defined by the wall 35 on the right and the angled hopper wall 30 on the left so that granules 31 in the hopper are constrained to flow downwardly to the relatively narrow mouth 34 of the hopper 29 under the influence of gravity.

The pocket wheel 36 is rotatably mounted at the bottom of the hopper adjacent the mouth 34. The pocket wheel 36 in the illustrated embodiment is formed with a hub 37 that is mounted on an axle 38, which, in turn, is journaled for rotation within a bearing assembly 39. The bearing assembly 39 is mounted to a side wall 25 (FIG. 2) of the system, which is not visible in the partial cross sectional view of FIG. 2. In operation, as described in more detailed below, the pocket wheel 36 is rotated in direction 41 in indexed increments by a computer controlled servo motor and gear train.

The pocket wheel 36 is generally cylindrical in shape except that its peripheral portion is formed or otherwise configured in this embodiment to define a series of pockets 42 separated by raised lands 43. There are a total of six pockets in the embodiment of FIG. 3, but it will be understood by the skilled artisan that this is not a limitation of the invention and that more or fewer than six pockets may be provided. In any event, the pockets are sized such that they define a volume between opposing lands and the sides of the pockets that is substantially equal to the desired volume of a charge of granules to be deposited onto the moving asphalt coated strip 32 below.

A baffle 44 extends downwardly from the wall 35 of the hopper to define a lower end of the store of granules 31, and a seal mount fixture 46 is attached to the lower end of the baffle 44 and extends downwardly therefrom. Secured within the seal mount fixture 46 is an elongated seal 48 that is held by the seal mount fixture at a position such that the seal 48 engages against the raised lands 43 of the pocket wheel 36 as the lands move past the seal 48. Similarly, the seal 48 rides across the open pockets of the pocket wheel as the pockets rotate past the seal. In the illustrated embodiment, the seal 48 comprises a set of brushes 49 fixed within the seal mount fixture 46 and extending to engage the passing lands, thereby forming a brush seal. It is not necessary that the seal between the seal 48 and the raised lands be water tight. It is only necessary that the seal 48 seal substantially against migration of granules past the seal as the pocket wheel rotates. The brush seal created by the set of brushes 49 has proven adequate to meet this need. Further, the brush seal shown in this embodiment have proven to function well for leveling a charge of granules in the pockets as the pockets rotate past the seal.

Although brush seals are shown and described above, seals other than brush seals, such as, for instance, rubber fins, a solid gate, a movable gate, a rotary gate, or any other mechanism that prevents unwanted granules from migrating past the periphery of the pocket wheel may be substituted for the illustrated brush seals. Any and all sealing mechanisms should be construed to be equivalent to the illustrated brush seals in FIG. 2. Further, the location or position of the seal around the periphery of the pocket wheel also may be adjusted by an adjustment slot 47 or other appropriate mechanism to change the angle of attack and other characteristics of granules dispensed during operation of the system, as described in more detail below.

Operation of the system 28 to perform the method of the invention will now be described in more detail with continuing reference to FIG. 3. The system 28 is mounted along a shingle fabrication line just above a conveyor along which a strip 32 of substrate material coated with hot liquid asphalt is conveyed in a downstream or machine direction 33 at a production speed of S feet per minute. The hopper 29 of the system is filled with granules 31 to be dispensed intermittently onto the surface of the strip 32 in substantially rectangular patterns as the strip 32 moves past and below the granule delivery system 28. As the sticky asphalt coated strip 32 moves past the granule delivery system, a controller (not shown) causes the servo motor and gear train (not shown) to rotate the pocket wheel through an increment of rotation and then to stop before rotating the wheel through a next successive increment.

In the illustrated embodiment of FIG. 3, the increment of rotation, indicated by arrow 51, is one-sixth of a full circle since the pocket wheel 36 of this particular embodiment has six pockets. Further an increment begins with the seal 48 engaging and sealing against the top of one of the lands that separate the pockets and ends with the seal 48 engaging and sealing against the top of the next successive land. Preferably, any acceleration or deceleration of the pocket wheel occurs while the seal is still riding on the land such that the pockets are moving at their full linear speed when they begin to be exposed beyond the seal. In the process, the pocket 42 between the two lands progressively rotates beyond the seal 48 and is exposed to the moving asphalt coated strip below.

With continued reference to FIG. 3, and with the forgoing description in mind, it will be seen that when the pocket wheel is rotated, each pocket drives through the store of granules 31 below the mouth 34 of the hopper just before encountering and moving beyond the seal 48. This fills the volume of the pocket with granules. As the pocket begins to rotate beyond the seal 48, the seal rides across the open pocket to level off the granule charge in the pocket at about the location of the tops of the lands so that the volume of the granule charge is about the same as the volume of the pocket.

As soon as the pocket begins to move past the seal 48, the granules in the pocket begin to fall toward the moving strip below under the influence of gravity, as indicated generally by arrow 48. At the same time, the granules leave the pocket with a forward speed imparted to them by the rotational momentum of the pocket wheel in direction 51. The downward and forward motion causes the charge of granules to approach the moving asphalt coated strip 32 at an angle 13, which is referred to herein as the angle of attack or angular discharge. The angular discharge of the granule charge can be varied according to need through adjustment of the circumferential location where the seal 48 engages the lands 43 of the pocket wheel. The stop position of the pocket wheel between intermittent rotations also can be adjusted to affect the angular discharge of the charge of granules as needed.

In reality, it is desired that the forward speed of the granules as the charge of granules leaves the pocket be approximately the same as the production speed of the asphalt coated strip below. This forward speed is established by the rate at which the pocket wheel is rotated by the servo motor and can be varied to match a particular production speed by varying this rate of rotation. In this way, the granules fall straight down into the sticky asphalt from the perspective of the moving strip so that they are less likely to bounce or otherwise be scattered when they hit the surface of the strip. Such scattering is further reduced since the granules can be released with the present invention, unlike prior art devices, very close to the surface of the strip. The granules therefore have less momentum to dissipate when they strike the asphalt and are less likely to bounce and otherwise scatter. The ultimate result is that the charge of granules are deposited on the asphalt in a relatively sharply defined grouping with sharp edges and very little if any patterning across the grouping. Further, it has been discovered that these characteristics can be maintained within very acceptable tolerances at high production speeds of over 800 FPM and higher, which has not been possible with traditional prior art granule delivery systems.

EXAMPLE

A prototype of the present invention, shown in FIG. 2, was constructed for testing the methodology of the invention to deposit granules at high speeds. A strip of cardboard was obtained to mimic an asphalt coated strip and the strip was placed beneath the prototype system, which was filled with granules. The pocket wheel was then indexed as described above to deposit a charge of granules onto the cardboard. In this example, the linear speed of rotation at the pockets of the pocket wheel was about 300 FPM and for this test, the cardboard strip was stationary. The test was repeated three times at different locations on the cardboard strip and results are illustrated in the photograph of FIG. 3. In this photograph, the three deposits of granules 62, 63, and 64 are shown with respective leading edges 66, 67, and 68; respective trailing edges 69, 71, and 72; and side edges 74. It can be seen that the trailing edges 69, 71, and 72 are sharp and well defined and also that the side edges (less important in reality) also are well defined.

In this example, the forward throw of granules at the leading edges 66, 67, and 68 is clearly visible, but it is believed that this is due to the fact that the cardboard strip of the experiment was stationary and not moving. Thus, the forward momentum of the granules relative to the stationary strip of cardboard tended to throw them forward on the strip. When operating on a production line, the linear speed of the line will be matched by the linear speed of rotation of the pocket wheel such that the granules will fall straight down onto the asphalt coating from the perspective of the moving strip. This should result in a clear well defined pattern (rectangular in this example) without tailings due to acceleration and deceleration profiles. The desired placement of the granules onto the asphalt of the moving sheet can be accomplished largely by appropriate programming of the indexer and servo motor apparatus. As a result, it is believed that crisply patterned deposits of granules can be placed onto a moving asphalt coated strip at production speeds heretofore not achievable.

The invention has been described herein in terms of preferred embodiments and methodologies considered by the inventor to represent the best mode of carrying out the invention. It will be understood by the skilled artisan; however, that a wide range of additions, deletions, and modifications, both subtle and gross, may be made to the illustrated and exemplary embodiments without departing from the spirit and scope of the invention set forth in the claims. For example, while the pockets of the illustrated embodiment are generally rectangular for depositing rectangular patterns of granules onto an asphalt coated strip, this is not a limitation of the invention. The pockets can, in fact, be formed with any shape that results in a corresponding desired pattern of granules on the strip. Such custom shaped patterns of deposited granules have heretofore not been feasible with prior art techniques. The pockets may be trapezoidal in shape, for instance, to deposit wedge-shaped patterns of granules. The edges of the pockets formed by the lands need not be straight but may instead be irregularly shaped to affect the deposited patterns of granules in a desired way. The number of pockets shown in the illustrated embodiment is not a limitation and more or fewer can be provided within the scope of the invention. The pockets in the illustrated embodiment are fixed in size and equal in size. However, it is contemplated that the pockets may be adjustable in size or shape by, for example, implementation of inserts and/or they may be of different sizes and/or shapes to obtain new and unknown granule patterns on shingle products. These and other modifications might well be made by one of skill in this art within the scope of the invention, which is delineated only by the claims.

What is claimed is:

1. A shingle manufacturing system comprising:

a conveyor for moving an asphalt coated strip in a downstream direction at a predetermined rate;

a hopper disposed above the conveyor and defining an interior volume for receiving and containing a store of granules to be dispensed onto the moving asphalt coated strip below, the hopper having a lower end portion;

a wheel having a periphery and being mounted at the lower end portion of the hopper for rotation about a substantially horizontal axis of rotation;

at least one depressed pocket and at least one raised land formed in the periphery of the wheel, the at least one pocket having a length around the periphery of the wheel and being defined between ends of the at least one raised land;

a seal located at the lower end portion of the hopper below the axis of rotation of the wheel and extending toward the wheel, the seal being configured to engage against the at least one raised land of the wheel as the at least one raised land moves past the seal and to ride across the at least one pocket of the wheel as the at least one pocket moves past the seal;

the seal having a thickness that is less than the length of the at least one pocket;

the store of granules extending downwardly below the axis of rotation of the wheel and being at least partially contained at a lower extent by the seal;

the wheel being positioned such that rotation of the wheel causes the at least one depressed pocket to move repeatedly through a first position exposed to the store of granules; a second position wherein a leading portion of the at least one depressed pocket is exposed to and spaced from the asphalt coated strip below the hopper while a trailing portion of the at least one depressed pocket remains exposed to the store of granules; and a third position past the seal; and a motor operatively coupled to the wheel for rotating the wheel according to predetermined criteria;

the at least one depressed pocket collecting granules when in the first position, carrying the collected granules progressively past the seal when moving from the first position to the second position to level the granules in the depressed pocket and begin to drop the granules onto the moving asphalt coated strip as the pocket moves past the seal, and dropping all of the collected granules onto the asphalt coated strip below when moving past the seal to the third position.

2. A shingle manufacturing system as claimed in claim 1 wherein a plurality of depressed pockets separated by a plurality of raised lands are formed in the periphery of the wheel.

3. A shingle manufacturing system as claimed in claim 2 wherein the plurality of depressed pockets are substantially the same shape.

4. A shingle manufacturing system as claimed in claim 3 wherein the shape is substantially rectangular for dropping granules in a rectangular pattern onto the asphalt coated strip below.

5. A shingle manufacturing system as claimed in claim 3 wherein the shape is substantially non-rectangular for dropping granules in a non-rectangular pattern onto the asphalt coated strip below.

6. A shingle manufacturing system as claimed in claim 1 wherein the predetermined criteria includes intermittently rotating the wheel through a predetermined angle of rotation.

7. A shingle manufacturing system as claimed in claim 1 wherein the seal is a brush seal.

8. A shingle manufacturing system as claimed in claim 1 wherein the predetermined criteria includes a surface speed of the periphery of the wheel that substantially matches the predetermined rate of the asphalt coated strip.

9. A shingle manufacturing system as claimed in claim 1 wherein the predetermined criteria includes intermittent rotation to drop the collected granules in an intermittent pattern onto the asphalt coated strip below.

10. A shingle manufacturing system as claimed in claim 1 wherein the motor comprises a computer controllable servo motor.

11. A shingle manufacturing system as claimed in claim 10 further comprising a gear train rotatably coupling the servo motor to the wheel.

12. A shingle manufacturing system as claimed in claim 1 wherein the at least one depressed pocket comprises six pockets.

13. An apparatus for dropping granules in predetermined patterns onto a moving asphalt coated strip in the manufacturing of asphalt shingles, the apparatus comprising;

a hopper for containing a store of granules, the hopper having a lower extent above the moving asphalt coated strip;

a wheel having a circumferential surface and being mounted at the lower extent of the hopper such that a portion of the circumferential surface of the wheel is exposed to a store of granules within the hopper;

a plurality of recessed pockets formed around the circumferential surface of the wheel, the recessed pockets being separated by raised lands;

a seal mounted at the lower extent of the hopper, the seal engaging the circumferential surface of the wheel and at least partially containing the store of granules within the hopper;

a motor for rotating the wheel according to predetermined criteria;

each of the pockets collecting a charge of granules when the pocket is exposed to the store of granules within the hopper;

the seal being sized and configured so that as the wheel rotates, each of the pockets moves through a position wherein a leading portion of the pocket is exposed to the moving asphalt coated strip below to begin to drop the charge of granules while a trailing portion of the pocket remains exposed to the store of granules within the hopper.

14. An apparatus as claimed in claim 13 wherein the seal has a thickness that is less than a circumferential length of the plurality of pockets.

15. An apparatus as claimed in claim 13 wherein the seal comprises a brush seal.

16. An apparatus as claimed in claim 13 wherein the predetermined criteria comprises intermittently.

17. An apparatus as claimed in claim 13 wherein the predetermined criteria comprises a speed that is not the same as the speed of the moving asphalt coated strip.

* * * * *